US008562743B2

(12) United States Patent
Strang

(10) Patent No.: US 8,562,743 B2
(45) Date of Patent: Oct. 22, 2013

(54) METHOD AND APPARATUS FOR ATOMIC LAYER DEPOSITION

(75) Inventor: Eric J. Strang, Chandler, AZ (US)

(73) Assignee: Tokyo Electron Limited, Tokyo (JP)

( * ) Notice: Subject to any disclaimer, the term of this patent is extended or adjusted under 35 U.S.C. 154(b) by 368 days.

(21) Appl. No.: 13/098,991

(22) Filed: May 2, 2011

(65) Prior Publication Data

US 2011/0203523 A1 Aug. 25, 2011

Related U.S. Application Data

(62) Division of application No. 10/980,172, filed on Nov. 4, 2004, now abandoned.

(51) Int. Cl.
*C23C 16/00* (2006.01)
*C23F 1/00* (2006.01)
*H01L 21/306* (2006.01)

(52) U.S. Cl.
USPC ..... 118/715; 118/725; 156/345.33

(58) Field of Classification Search
USPC ..... 118/715; 153/345.33, 345.34; 156/345.33, 345.34
See application file for complete search history.

(56) References Cited

U.S. PATENT DOCUMENTS

| | | | | |
|---|---|---|---|---|
| 5,445,699 | A | 8/1995 | Kamikawa et al. | |
| 6,857,447 | B2 | 2/2005 | Olander et al. | |
| 7,435,396 | B2 * | 10/2008 | Muraoka et al. | 422/242 |
| 2002/0094306 | A1 | 7/2002 | Hara et al. | |
| 2003/0047195 | A1 * | 3/2003 | DeYoung et al. | 134/12 |
| 2003/0180458 | A1 * | 9/2003 | Sneh | 427/248.1 |
| 2003/0213560 | A1 | 11/2003 | Wang et al. | |
| 2004/0107897 | A1 | 6/2004 | Lee et al. | |
| 2004/0123803 | A1 * | 7/2004 | Strang | 118/723 E |
| 2004/0144311 | A1 | 7/2004 | Chen et al. | |
| 2004/0237893 | A1 | 12/2004 | Park et al. | |

* cited by examiner

*Primary Examiner* — Rakesh Dhingra
(74) *Attorney, Agent, or Firm* — Oblon, Spivak, McClelland, Maier & Neustadt, L.L.P.

(57) ABSTRACT

A high pressure processing system including a chamber configured to house a substrate. A fluid introduction system includes at least one composition supply system configured to supply a first composition and a second composition, and at least one fluid supply system configured to supply a fluid. The fluid supply system is configured to alternately and discontinuously introduce the first composition and the second composition to the chamber within the fluid.

20 Claims, 7 Drawing Sheets

METHOD AND APPARATUS FOR ATOMIC LAYER DEPOSITION

CROSS-REFERENCE TO RELATED APPLICATIONS

This application is a division of U.S. application Ser. No. 10/980,172 filed Nov. 4, 2004, the entire contents of which is incorporated herein by reference.

BACKGROUND OF THE INVENTION

1. Field of the Invention

The present invention relates to forming a film on a substrate of an integrated circuit, and more particularly to forming the film on the integrated circuit substrate by atomic layer deposition.

2. Discussion of the Related Art

During fabrication of an integrated circuit (IC), various materials are formed on and removed from the IC at various times. For example, (dry) plasma etching is often used to remove or etch material along fine lines or within vias or contacts patterned on a silicon substrate of the IC. Alternatively, for example, vapor deposition processes are often used to form or deposit a material film along fine lines or within vias or contacts on the silicon substrate. Such vapor deposition processes include chemical vapor deposition (CVD) and plasma enhanced chemical vapor deposition (PECVD).

In PECVD, plasma is used to alter or enhance deposition of the material film. For instance, plasma excitation often results in a reaction forming the material film at a temperature that is significantly lower than a temperature required for producing a similar film by thermally excited CVD. In addition, plasma excitation often activates chemical reactions forming the material film, which are not energetically or kinetically favored in thermal CVD. It is possible to vary both chemical and physical properties of PECVD films over a relatively wide range by adjusting parameters of the PECVD process.

However, as geometries associated with ICs continue to decrease, with via dimensions falling below about 100 nanometers, deposition requirements for the film become increasingly critical. Recently, atomic layer deposition (ALD), which is a form of PECVD/CVD, has been recognized as potentially providing ultra-thin gate film formation in front end-of-line (FEOL) operations, as well as ultra-thin barrier layer and seed layer formation for metallization in back end-of-line (BEOL) operations. During ALD, two or more process gases are introduced alternately and sequentially to form a material film one or more monolayers at a time. However the delivery of each of the process gases should be precisely controlled to form the film.

Further, the size of a feature of the ICs generally decreases at a rate greater than a rate at which a thickness of the film decreases. Thus, an aspect ratio of the feature (i.e., a ratio of a depth to a width of the feature) generally increases as the IC feature size decreases (for example, in the order of 10:1). As the aspect ratio increases, it becomes increasingly important to ensure that components of the film are uniformly deposited within the feature.

SUMMARY OF THE INVENTION

Accordingly, one object of the present invention is to provide an improved method and apparatus for depositing material in a feature of a semiconductor.

Another object of the present invention is to provide a method and apparatus for performing atomic layer deposition with improved deposition characteristics.

These and/or other objects of the present invention may be provided by a high pressure processing system. According to one aspect of the invention, the system includes a chamber configured to house a substrate. A fluid introduction system includes at least one composition supply system configured to supply a first composition and a second composition, and at least one fluid supply system configured to supply a fluid. The fluid supply system is configured to alternately and discontinuously introduce the first composition and the second composition to the chamber within the fluid.

Another aspect of the present invention provides a method for treating a substrate, including disposing the substrate, in a chamber, and alternately and discontinuously exposing the substrate to a fluid, a first composition, and a second composition in the chamber to facilitate deposition of a film on the substrate.

Yet another aspect of present invention provides a high pressure processing system including a chamber configured to house a substrate, and a subassembly used for introducing to the substrate a first composition and a second composition alternately and discontinuously disposed within a carrier fluid.

BRIEF DESCRIPTION OF THE DRAWINGS

An appreciation of the invention and advantages thereof are obtained as the same become better understood by reference to the following description when considered in connection with the accompanying drawings, wherein.

DETAILED DESCRIPTION

With reference to the drawings, wherein like reference numbers throughout the several views identify like and/or similar elements, exemplary embodiments of the invention are now described.

In the following description, to facilitate a thorough understanding of the invention and for purposes of explanation and not limitation, specific details are set forth, such as a particular geometry of the high pressure processing system and various descriptions of the system components. However, it should be understood that the invention may be practiced with other embodiments that depart from these specific details.

Nonetheless, it should be appreciated that, contained within the description are features which, notwithstanding the inventive nature of the general concepts being explained, are also of an inventive nature.

The present invention can provide a method and apparatus for forming a film on a substrate of an integrated circuit, such as by atomic layer deposition (ALD). Specifically, the present invention can use a high pressure fluid, such as a high pressure or supercritical fluid that exhibits substantially no surface tension, to cyclically and sequentially introduce two or more process compositions to a surface of the substrate. The process compositions are selected to alter one or both of a material composition and a topography of the substrate surface, to form the desired film, such as a thin film of metal nitride, metal oxide, nitrides, or oxides, one or more monolayers at a time. The present inventors have recognized that because the high pressure fluid exhibits substantially no surface tension, the high pressure fluid is able to penetrate a feature of the substrate which has a relatively small size, and is able to effectively and uniformly deliver the process compositions to the feature.

Figure 1:
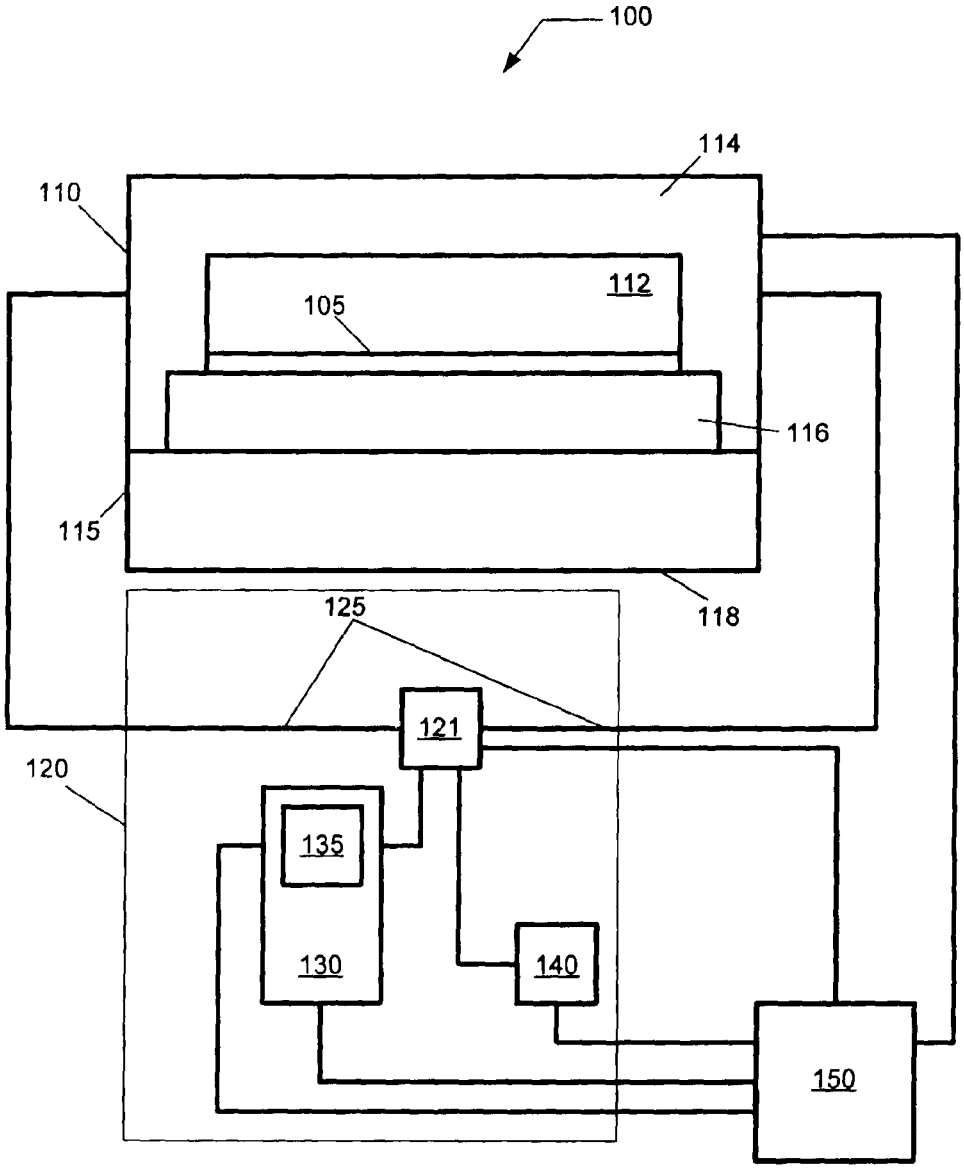
FIG. 1 is a schematic showing a high pressure processing system according to the present invention.

FIG. 1 is a schematic showing a high pressure processing system 100, which is configured to process a substrate 105, in accordance with the present invention. The processing system 100 can include a processing chamber 110 in which the substrate 105 is processed by a processing fluid including the high pressure fluid and the process compositions. The processing system can also include a high pressure fluid introduction system 120 having one or more of a recirculation system 121, a process chemistry supply system 130, and a high pressure fluid supply system 140, as well as a controller 150, configured to provide the processing fluid to the substrate 105.

Non-limiting examples of materials of the substrate 105, which can be processed by the high pressure processing system 100, can include a semiconductor material, a metallic material, a dielectric material, a ceramic material, and a polymer material. Examples of the semiconductor material can include Si, Ge, Si/Ge, and GaAs. Examples of the metallic material can include Cu, Al, Ni, Pb, Ti, and Ta. Examples of the dielectric material can include silica, silicon dioxide, quartz, aluminum oxide, sapphire, a low dielectric constant material, TEFLON, and polyimide. Examples of the ceramic material can include aluminum oxide and silicon carbide.

The processing chamber 110 can be configured to process the substrate 105 by exposing the substrate 105 to the processing fluid including the high pressure fluid supplied by the high pressure fluid supply system 140, the process compositions supplied by the process chemistry supply system 130, or a combination of the high pressure fluid and the process compositions. An example of such a processing chamber 110, which can be included in the high pressure processing system 100 of the present invention, is disclosed in co-pending U.S. application Ser. No. 09/912,844 to Biberger et al., filed on Jul. 24, 2001, the disclosure of which is incorporated by reference herein in its entirety.

The processing chamber 110 can include a processing space 112 defining an upper chamber assembly 114 and a lower chamber assembly 115. The upper chamber assembly 114 can include a heater configured to heat one or more of the processing chamber 110/the processing space 112, the substrate 105, and the processing fluid. The upper chamber assembly 114 can include a flow device configured to flow the processing fluid through the processing chamber 110. The flow device can be configured to flow the processing fluid through the processing chamber 110 in one or more flow patterns, including substantially circular and linear flow patterns.

The lower chamber assembly 115 can include a platen 116 having an upper surface configured to support the substrate 105. A drive mechanism 118 can be used to translate the platen 116, such that the substrate 105 can be loaded and unloaded from the platen 116. A lift pin assembly can be used to displace the substrate 105 from the upper surface of the platen 116 during loading and unloading of the substrate 105. The platen 116 can be used to seal the upper chamber assembly 114 from the lower chamber assembly 115.

The platen 116 can also ue configured to heat, such as with a resistive heating element, or to cool the substrate 105 one or more of before, during, and after processing of the substrate 105 with the processing fluid. In a preferred embodiment of the invention, the platen 116 can be configured to heat the substrate 105 to a temperature of from about 100° C. to about 500° C., and more preferably to heat the substrate 105 to a temperature of at least about 500° C.

The high pressure processing system 110 can include a transfer system configured to move the substrate 105 into and out of the processing chamber 110, such as through a slot in the processing chamber 110. The slot in the processing chamber 110 can be configured to be opened and closed as a result of movement of the platen 116, or as a result of operation of a gate valve.

The recirculation system 121 can be configured to regulate flow of the processing fluid through the recirculation system 121 and through the processing chamber 110. The recirculation system 121 can include one or more valves, back-flow valves, filters, pumps, and heaters to regulate or maintain a flow of the processing fluid through the recirculation system 121 and the processing chamber 110.

The process chemistry supply system 130 can be configured to introduce the two or more process compositions or film precursors into the high pressure or supercritical fluid provided by the high pressure fluid supply system 140, to ultimately form a thin film on the substrate 105. The high pressure fluid can act as a carrier for the two or more process compositions provided by the process chemistry supply system 130. Non-limiting examples of the thin film ultimately formed on the substrate 105 can include a metal film, a metal oxide film, a metal nitride film, a nitride film, an oxide film, a dielectric film, a low dielectric constant (low-k) film, and a high dielectric constant (high-k) film.

It is to be understood that various components of the processing fluid, including the high pressure fluid, source reagent (precursor) compounds, complexes, and materials, can be determined based on various factors, including characteristics of the substrate 105 on which the film is to be formed. Further, the processing fluid can optionally include one or more co-solvents, co-reactants, surfactants, diluents, and other deposition-facilitating or composition-stabilizing component.

Figure 2:
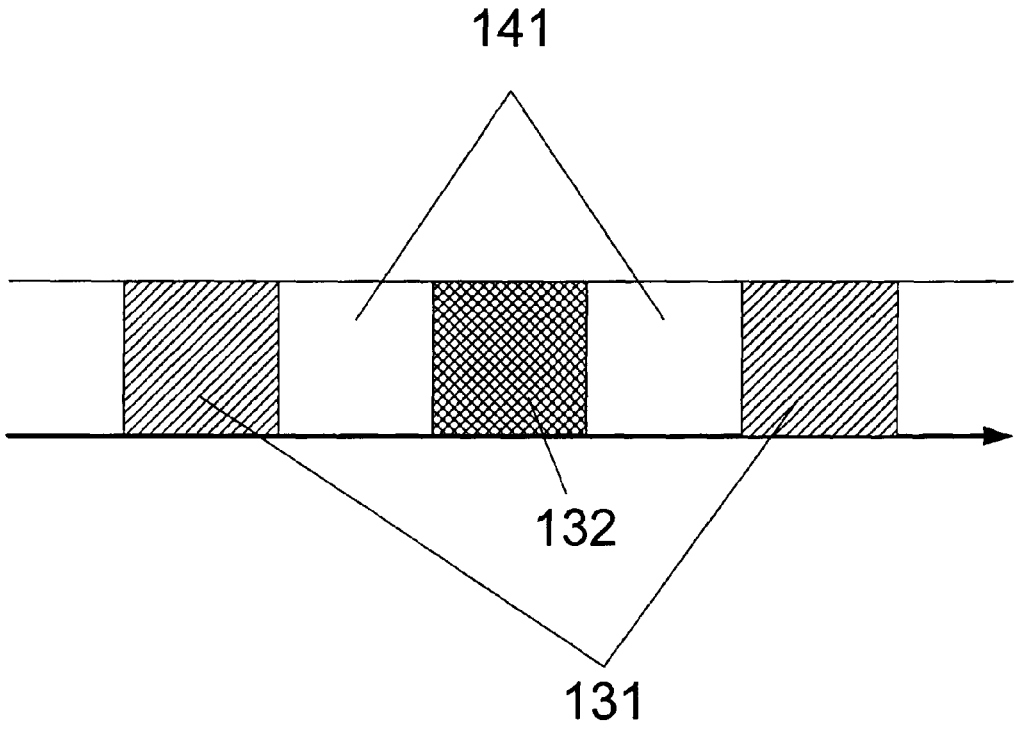
FIG. 2 is a detail view of a high pressure fluid acting as a carrier for two process compositions.

In a preferred embodiment of the invention, the high pressure fluid can transport a first process composition including a precursor component to contact the substrate 105, which is heated. A second process composition including a reducing agent can also be transported by the high pressure fluid to the heated substrate 105, such that the second process composition can contact the first process composition on the heated substrate 105. Reaction between the first and second process compositions forms the thin film. Preferably, the high pressure fluid can transport the first and second process compositions provided by the process chemistry supply system 130 cyclically and sequentially to the substrate 105. FIG. 2 is a detail view of a specific example of the processing fluid. As shown in the figure, the processing fluid can include the high pressure fluid 141, provided by the high pressure fluid supply system 140, acting as a carrier for the two process compositions 131 and 132, provided by the process chemistry supply system 130.

Non-limiting examples of the first process composition can include a source reagent compound, an organo-metallic species, and a metal coordination complex for forming a metal, or dielectric film on the substrate 105. Further examples of the first process composition can include a dielectric precursor, such as a low-k dielectric precursor. Examples of the low-k dielectric precursors can include one or more of polymeric, oligomeric, pre-polymeric, and monomeric precursor components. Still further examples of the first process composition can include alkyl silanes, siloxane precursors, and organic-based non-silicon-containing low-k precursors, such as SiLK low-k dielectric thermosetting resin, commercially available from The Dow Chemical Company. Examples of siloxane precursors can include alkyl siloxanes, and cyclosiloxanes, such as tetramethylcyclotetrasiloxane (TMCTS) and octamethyltetracyclosiloxane (OMCTS).

Further examples of the first process composition can include a metal precursor, and the second process composition can include a reducing agent. For tungsten film deposition, the metal precursor can include $W(CO)_6$ or $W(PF_3)_6$. For copper film deposition, the metal precursor can include at least one of: Cu (II) (β-diketonato)$_2$ species, such as Cu (II) (acac)$_2$, Cu (II) (thd)$_2$, and Cu (tod)$_2$ as well as other non-fluorinated β-diketonate copper compounds and complexes, Cu (carboxylate)$_2$ species, such as Cu (formate)$_2$ and Cu (acetate)$_2$ and other long-chain (e.g., $C_8$-$C_{40}$ and more preferably from $C_8$-$C_{30}$) carboxylates, and (cyclopentadienyl) CuL complexes (wherein L is a suitable or desired ligand species), such as CpCu (I) $PMe_3$, such precursors being fluorine-free and soluble in pentane or other organic solvents; copper (I) phenyl tetramers, such as copper (I) pentaflurophenyl or copper (I) t-butyl phenyl tetramer; and copper (I) amides, such as bis(trimethylsilylamide) tetramer. The reducing agent can include ammonia ($NH_3$), hydrogen, or isopropyl alcohol.

A barrier layer precursor material can be of any type suitable for forming a barrier layer, e.g., of TiN, TaN, NbN, WN or corresponding silicides. Non-limiting examples of precursor components can include titanium (IV) tetrakis-dialkylamides such as tetrakis diethylamido titanium (TDEAT), tetrakis dimethylamino titanium (TDMAT), and pyrozolate titanium compounds and other titanium amide and imido compounds. Examples of tantalum nitride (TaN) barrier precursor compounds can include Ta (IV) pentakis(dialkylamido) compounds, such as pentakis ethylmethylamido tantalum (PEMAT), pentakis dimethylamido tantalum (PDMAT) and pentakis diethylamido tantalum (PDEAT).

Furthermore, as discussed above, co-solvent or co-reactant species useful in the deposition of the process compositions can be of any suitable or desired type. Non-limiting examples of the species can include methanol, ethanol, and higher alcohols, N-alkylpyrrolidones or N-arylpyrrolidones, such as N-methyl-, N-octyl-, or N-phenyl-pyrrolidones, dimethylsulfoxide, sulfolane, catechol, ethyl lactate, acetone, butyl carbitol, monoethanolamine, butyrol lactone, diglycol amine, y-butyrolactone, butylene carbonate, ethylene carbonate, and propylene carbonate. Examples of surfactants can include any suitable or desired type, such as anionic, neutral, cationic, and zwitterionic types. Examples of surfactant species can include acetylenic alcohols and diols, long akyl chain secondary and tertiary amines, and their respective fluorinated analogs.

In a preferred embodiment of the invention, the process chemistry supply system 130 fluidly communicates with the recirculation system 121. It is to be understood, however, that the process chemistry supply system 130 is not required to communicate with the recirculation system 121, and can communication with one or more components of the high pressure processing system 100.

The high pressure fluid supply system 140 can be configured to introduce the high pressure or supercritical fluid having a pressure substantially near a critical pressure for the fluid or in a supercritical state. Non-limiting examples of the high pressure fluid that can be used to transport the process compositions provided by the process chemistry supply system 130 can include carbon dioxide, oxygen, argon, krypton, xenon, ammonia, methane, methanol, dimethyl ketone, hydrogen, and sulfur hexafluoride.

When the high pressure fluid supply system 140 uses carbon dioxide as the high pressure fluid, the carbon dioxide gas at standard pressure and temperature undergoes a transition to a supercritical fluid above a critical temperature and pressure of about 31.1° C. and 1070 psi, respectively. Such a high pressure fluid supply system 140 can include a carbon dioxide source and one or more flow control elements configured to generate the supercritical fluid. The carbon dioxide source can include a carbon dioxide feed system, and the flow control elements can include one or more supply lines, valves, filters, pumps, and heaters. The high pressure fluid supply system 140 can include an inlet valve configured to open and close to allow or prevent the stream of supercritical carbon dioxide from flowing into the processing chamber 110. Further, the controller 150 can be used to determine or regulate one or more fluid parameters, such as pressure, temperature, process time, and flow rate.

It has been determined that the use of the supercritical fluid can permit penetration of high aspect ratio features and, therefore, can result in conformal deposition. Due to the progressively smaller dimensions of semiconductor patterns, the supercritical fluid assisted deposition of process compositions can result in the ability to penetrate small geometric structures, such as vias and trenches with high aspect ratios, on a semiconductor substrate, as well as to achieve improved homogeneity and extent of conformality of the deposited material, e.g., in films, layers and localized material deposits, particularly in instances in which the wettability of the substrate is low, as is often the case with semiconductor substrates.

In a preferred embodiment of the invention, the high pressure fluid supply system 140 fluidly communicates with the recirculation system 121. It is to be understood, however, that high pressure fluid supply system 140 is not required to communicate with the recirculation system 121, and can communicate with other components of the high pressure processing system 100, such as the processing chamber 110.

The controller 150 can be configured to deliver the process compositions provided by the process chemistry supply system 130 to the high pressure fluid provided by the high pressure fluid supply system 140 sequentially and cyclically.

In a preferred embodiment of the invention, the controller 150 can be coupled to the processing chamber 110, and the high pressure fluid introduction system 120 including the recirculation system 121, the process chemistry supply system 130, and the high pressure fluid supply system 140, to configure, monitor, operate, or control any or all of these components. It is to be understood, however, that the controller 150 is not required to be coupled to each of these components, and that the controller can be coupled to one or more additional components (e.g., controller or computer). It is to be further understood that the high pressure processing system 100 can include one or more of each of the processing chamber 110, and the high pressure fluid introduction system 120, the recirculation system 121, the process chemistry supply system 130, and the high pressure fluid supply system 140, and that the controller 150 can be used to configure, monitor, operate, or control any number of processing chambers 110, and high pressure fluid introduction systems 120 including one or more recirculation systems 121, chemistry supply systems 130, and high pressure fluid supply systems 140.

When the substrate 105 is processed in the processing chamber 110 of the high pressure processing system 100, the processing fluid including the process compositions sequentially and cyclically provided by the process chemistry supply system 130 into the high pressure fluid provided by the high pressure fluid supply system 140 can be introduced to the processing chamber 110. The processing fluid can be circulated through a circulation loop 125 provided by the processing chamber 110 and the recirculation system 121.

Preferably, the high pressure fluid is initially provided by the high pressure fluid supply system 140, and is circulated through the processing chamber 110. While the high pressure fluid is circulating, the process compositions are introduced sequentially and cyclically by the process chemistry supply system 130 into the high pressure fluid. The process chemistry supply system 130 can include an injection system 135 configured to inject the process compositions alternately and discontinuously over a time duration small with respect to the circulation time duration. In a preferred embodiment of the invention, the circulation time duration can be at least about 1 second, and more preferably can be at least about 5 seconds. Further, the time duration during which first and second process compositions can be introduced into the high pressure fluid can be at least about 1 millisecond, and more preferably can be at least about 10 milliseconds.

In a preferred embodiment of the invention, the injection system 135 can include one or more pulsed injection valves. Non-limiting examples of pulsed injection valve can include an electro-magnetic valve, such as a solenoidal valve, and a piezo-electric valve. The pulsed injection valve can include an automotive fuel injector valve or pulsed piezo-electric valve (e.g., piezo-electric actuated micro-machined valve), such as those available from the Robert Bosch Corporation, or as described in publications by Cross & Valentini, Bates & Burell, and Gentry & Giese, the contents of which are herein incorporated by reference in their entirety. Pulsed injection heads of the valves can provide pulse durations less than about one millisecond with a repetition rate (or pulse frequency) greater than about 1 kHz. One or more of the pulse frequency and pulse duty cycle can be determined to provide optimal sequencing of one or more process compositions provided by the process chemistry supply system 130.

The high pressure processing system 100 can optionally include a pressure control system. The pressure control system can be coupled to the processing chamber 110, and/or one or more components of the processing system 100. The pressure control system can include one or more pressure valves configured to exhaust the processing chamber 110 and/or to regulate pressure within the processing chamber 110. Further, the pressure control system can include one or more pumps configured to increase pressure within the processing chamber, and to evacuate the processing chamber 110. The pressure control system can be configured to seal the processing chamber 110, and/or to raise and lower the substrate 105 and the platen 116.

The high pressure processing system 100 can optionally include an exhaust control system. The exhaust control system can be coupled to the processing chamber 110, and/or one or more components of the processing system 100. The exhaust control system can include an exhaust gas collection vessel configured to remove contaminants from the processing fluid and/or to recyci the processing fluid.

Figure 3:
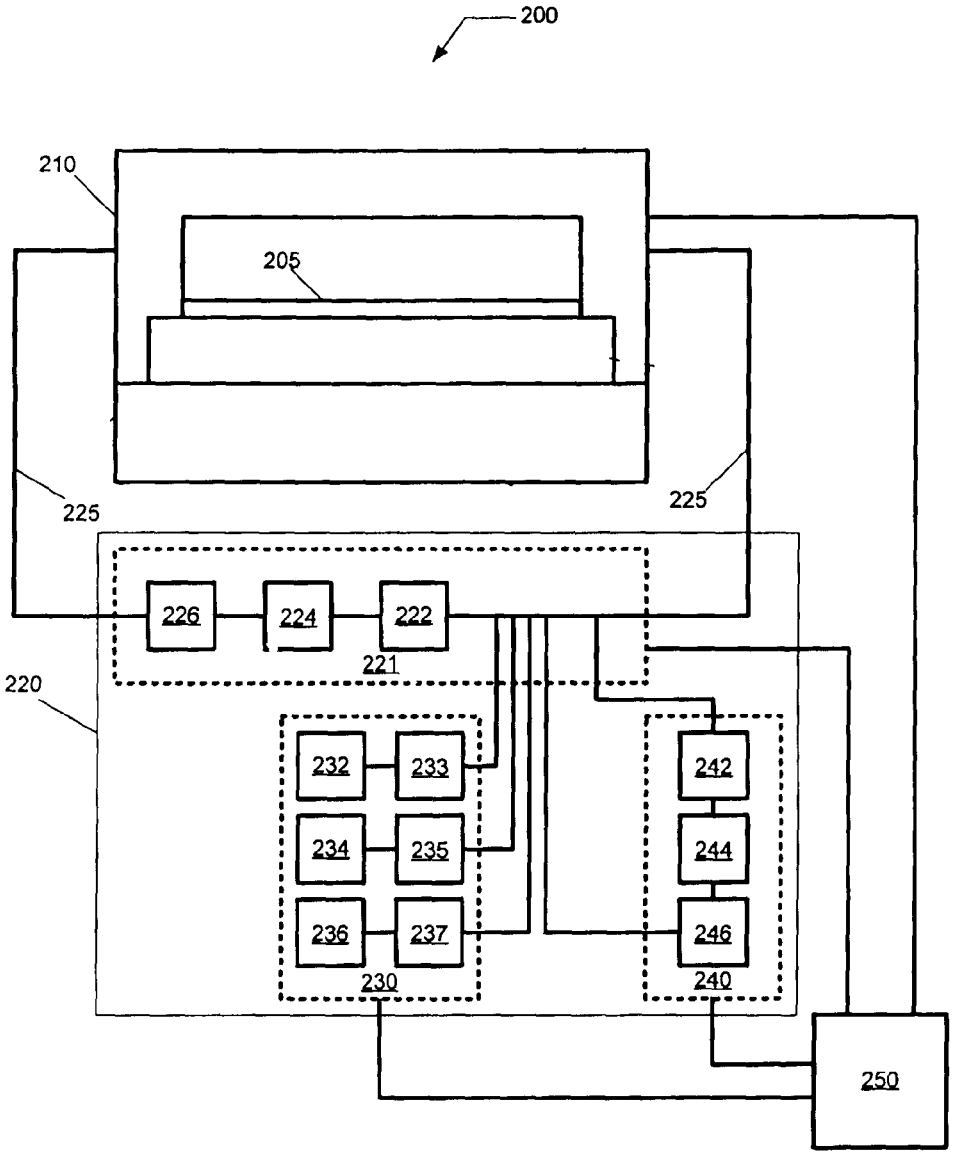
FIG. 3 is a schematic showing another embodiment of the high pressure processing system according to the present invention.

FIG. 3 is a schematic showing another embodiment of a high pressure processing system. It is to be understood that components of various embodiments of the high pressure processing system are similar to one another, except as otherwise stated in the descriptions of the embodiments.

The high pressure processing system 200 can include a processing chamber 210, a high pressure fluid introduction system 220 having a recirculation system 221, a process chemistry supply system 230, and a high pressure fluid supply system 240, as well as a controller 250.

The recirculation system 221 can include a recirculation fluid heater 222, a pump 224, and a filter 226. Additionally, the process chemistry supply system 230 can include one or more chemistry introduction systems. The chemistry introduction systems can include chemical sources 232, 234, 236, and injection systems 233, 235, 237. The injection systems 233, 235, 237 can include a pump and an injection valve. One or more of the injection valves can include a pulsed injection valve. The high pressure fluid supply system 240 can include a supercritical fluid source 242, a pumping system 244, and a supercritical fluid heater 246, as well as one or more or injection and exhaust valves.

When a substrate 205 is processed in the processing chamber 210 of the high pressure processing system 200, the processing fluid including the process compositions sequentially and cyclically provided by the process chemistry supply system 230 into the high pressure fluid provided by the high pressure fluid supply system 240 can be introduced to the processing chamber 210. The processing fluid can be circulated through a circulation loop 225 provided by the processing chamber 210 and the recirculation system 221.

Preferably, the high pressure fluid is initially provided by the high pressure fluid supply system 240, and is circulated through the processing chamber 210. While the high pressure fluid is circulating, the process compositions are introduced sequentially and cyclically by the process chemistry supply system 230 into the high pressure fluid. The process compositions can be injected by the process chemistry supply system 230 alternately and discontinuously over a time duration small with respect to the circulation time duration.

In a preferred embodiment of the invention, the injection systems 233, 235, and 237 can include one or more pulsed injection valves. Non-limiting examples of pulsed injection valve can include an electro-magnetic valve, such as a solenoidal valve, and a piezo-electric valve. The pulsed injection valve can include an automotive fuel injector valve or pulsed piezo-electric valve (e.g., piezo-electric actuated micro-machined valve). Pulsed injection heads of the valves can provide pulse durations less than about one millisecond with a repetition rate (or pulse frequency) greater than about 1 kHz. One or more of the pulse frequency and pulse duty cycle can be determined to provide optimal sequencing of one or more process compositions provided by the process chemistry supply system 230.

Figure 4:
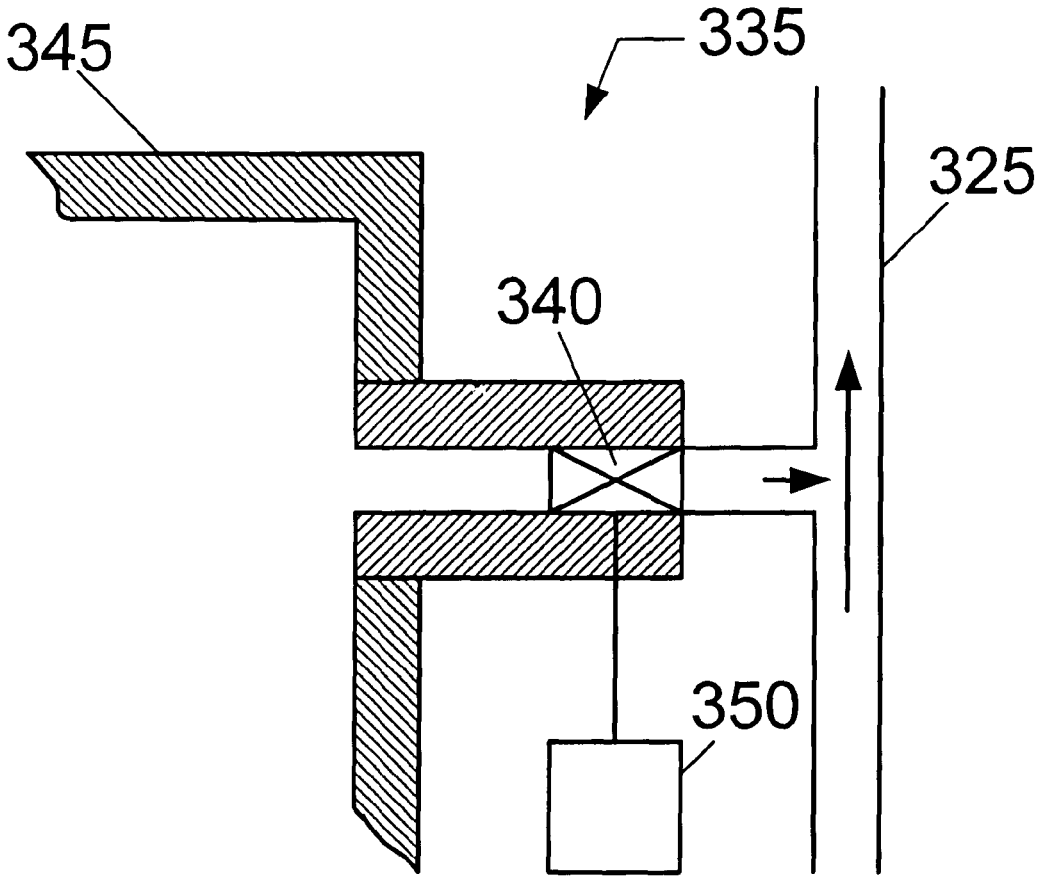
FIG. 4 is a detail view of an injection system including a pulsed injection valve.

FIG. 4 is a detail view of an injection system including a pulsed injection valve. The injection system 335 can include a pulsed injection valve 340 coupled to a high pressure supply reservoir 345. By this arrangement, the injection system 335 can be configured to introduce process chemistry from a process chemistry supply system to a high pressure fluid in a circulation loop 325. A controller 350 can be configured to determine one or more of the pulse frequency and pulse duty cycle. Additional injection systems can be used to injection additional process compositions into the high pressure fluid.

Figure 5:
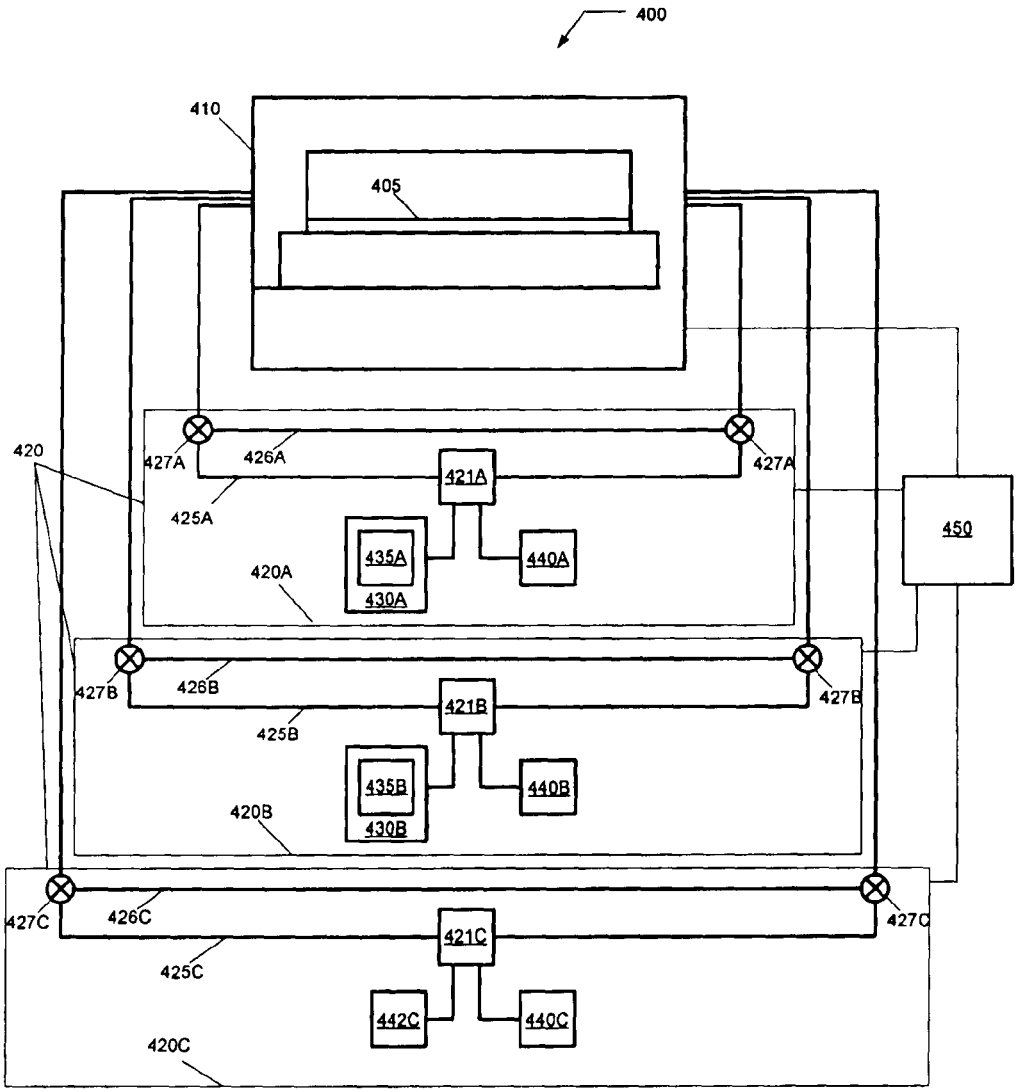
FIG. 5 is a schematic showing another embodiment of the high pressure processing system according to the present invention.

FIG. 5 is a schematic showing another embodiment of a high pressure processing system. The high pressure processing system 400 can include: a processing chamber 410; a high pressure fluid introduction system 420 including (i) a first recirculation system 420A, a process chemistry supply system 430A, a high pressure fluid supply system 440A, and a recirculation loop assembly 421A (ii) a second recirculation system 420B having a process chemistry supply system 430B, a high pressure fluid supply system 440B, and a recirculation loop assembly 421B, and (iii) a third recirculation system 420C including a high pressure fluid supply system 440C, and a recirculation loop assembly 421C; and a controller 450. The controller 450 can be coupled to the processing chamber 410, and the high pressure fluid introduction system 420 (i.e., the first, second, and third recirculation systems).

Each recirculation loop assembly 421A, 421B, and 421C can include a recirculation fluid heater, a pump, and a filter. Additionally, the first and second recirculation systems 420A, and 420B can include the process chemistry supply system 430A, and 430B configured to introduce first and second process compositions as described above. The process chemistry supply systems 430A, 430B can include chemical sources, and injection systems 435A, 435B. The injection system can optionally include pumps and injection valves. For example, as described above, each injection valve can include a pulsed injection valve. The high pressure fluid supply systems 440A, 440B, and 440C can include a supercritical fluid source, a pumping system, and a supercritical fluid heater. Moreover, one or more injection valves, or exhaust valves can be included with the high pressure fluid supply system. The third recirculation system 420C can include an exhaust system 442C configured to vent processing chamber 410, for example during a purge cycle. Recirculation systems 420A, 420B, and 420C can include primary recirculation lines 425A, 425B, and 425C, bypass lines 426A, 426B, and 426C, and one or more of valves 427A, 427B, and 427C.

During operation of the high pressure processing system 400, high pressure fluid from the high pressure fluid supply system 440C can be introduced to primary recirculation line 425C, and can pass through processing chamber 410, while a first process composition from the process chemistry supply system 430A and high pressure fluid from the high pressure fluid supply system 440A can be circulated through bypass line 426A, and while a second process composition from the process chemistry supply system 430B and high pressure fluid from the high pressure fluid supply system 440B can be circulated through bypass line 426B. Thereafter, the one or more of the valves 427C may be closed to the flow of high pressure fluid through primary circulation line 425C and the processing chamber 410, and the one or more of the valves 427A can be opened to the flow of the first process composition and high pressure fluid through primary circulation line 425A and processing chamber 410. Subsequently, the one or more valves 427A may be closed to the flow of high pressure fluid through primary circulation line 425A and the processing chamber 410, and the one or more valves 427B can be opened to the flow of the second process composition and high pressure fluid through primary circulation line 425B and processing chamber 410. This sequence may then be repeated. Therefore, substrate 405 is alternately and discontinuously exposed to high pressure fluid, high pressure fluid with the first process composition, and high pressure fluid with the second process composition. The high pressure processing system 400 can include additional recirculation systems configured to introduce additional process compositions.

Figure 6:
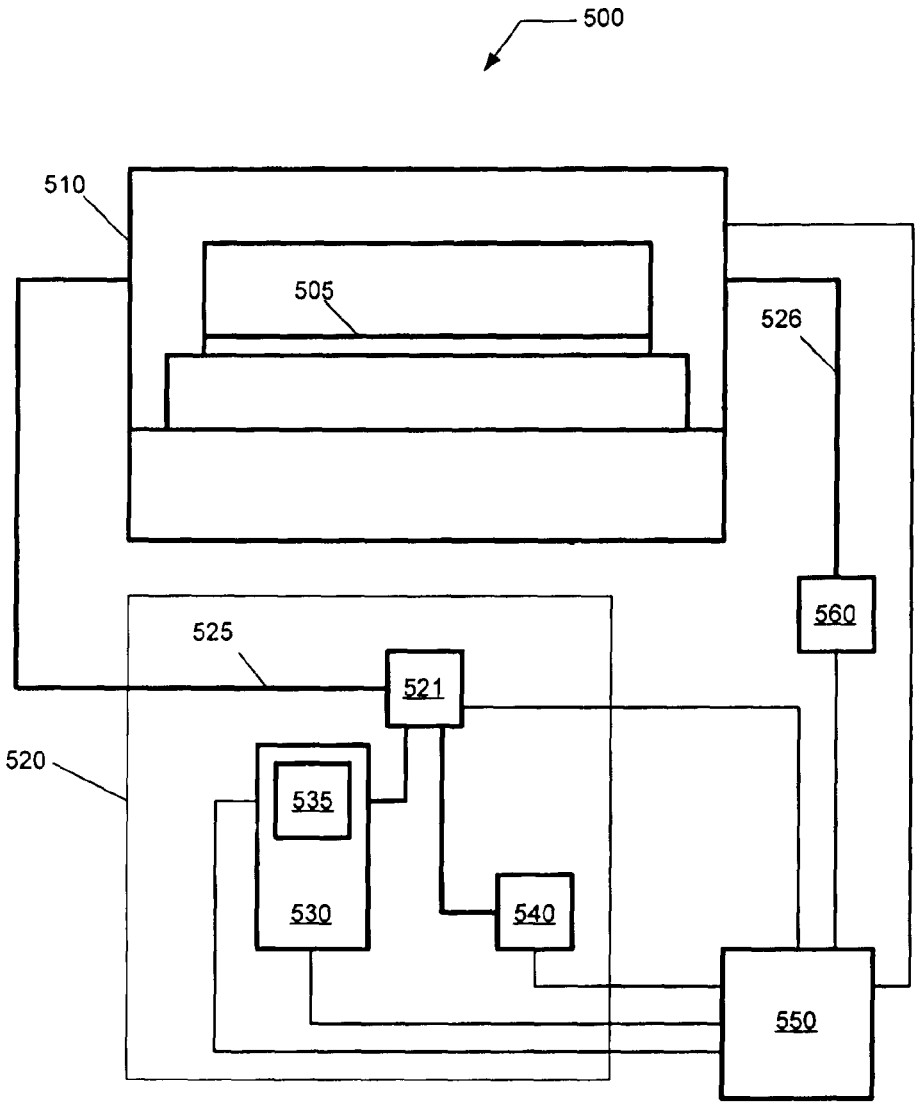
FIG. 6 is a schematic showing another embodiment of the high pressure processing system according to the present invention.

FIG. 6 is a schematic showing another embodiment of a high pressure processing system. The high pressure processing system 500 can include a processing chamber 510, a high pressure fluid introduction system 520 having a high pressure fluid delivery system 521, a process chemistry supply system 530 and a high pressure fluid supply system 540, and an exhaust system 560, as well as a controller 550. The controller 550 can be coupled to the processing chamber 510, the high pressure fluid introduction system 520 (i.e., the high pressure fluid delivery system 521, the process chemistry supply system 530 and the high pressure fluid supply system 540), and the exhaust system 560.

The high pressure fluid delivery system 521 can be coupled to the processing chamber 510 via an inlet line 525, and can include a fluid heater, a pump, and a filter. The process chemistry supply system 530 can include one or more chemistry introduction systems, each introduction system having a chemical source, and an injection system 535. The injection systems can include a pump and an injection valve. The injection valve can include a pulsed injection valve. The high pressure fluid supply system 540 can include a supercritical fluid source, a pumping system, and a supercritical fluid heater.

When a substrate 505 is processed in the processing chamber 510, high pressure fluid can be introduced to the processing chamber 510, and passed through the processing chamber 510 via the high pressure fluid introduction system 520. While high pressure fluid is passed through the processing chamber 510, process chemistry can be introduced to the flowing high pressure fluid from the process chemistry system 530 through the injection system 535 configured to inject the process chemistry alternately and discontinuously. For example, a first process composition and a second process composition can be introduced to the high pressure fluid, in a manner similar to that shown in FIG. 2. Once the high pressure fluid with or without one or more process compositions passes through the processing chamber 510, the exhaust system 560 coupled to the processing chamber 510 via an outlet line 526 can be configured to collect one or both of the high pressure fluid and the process compositions.

Figure 7:
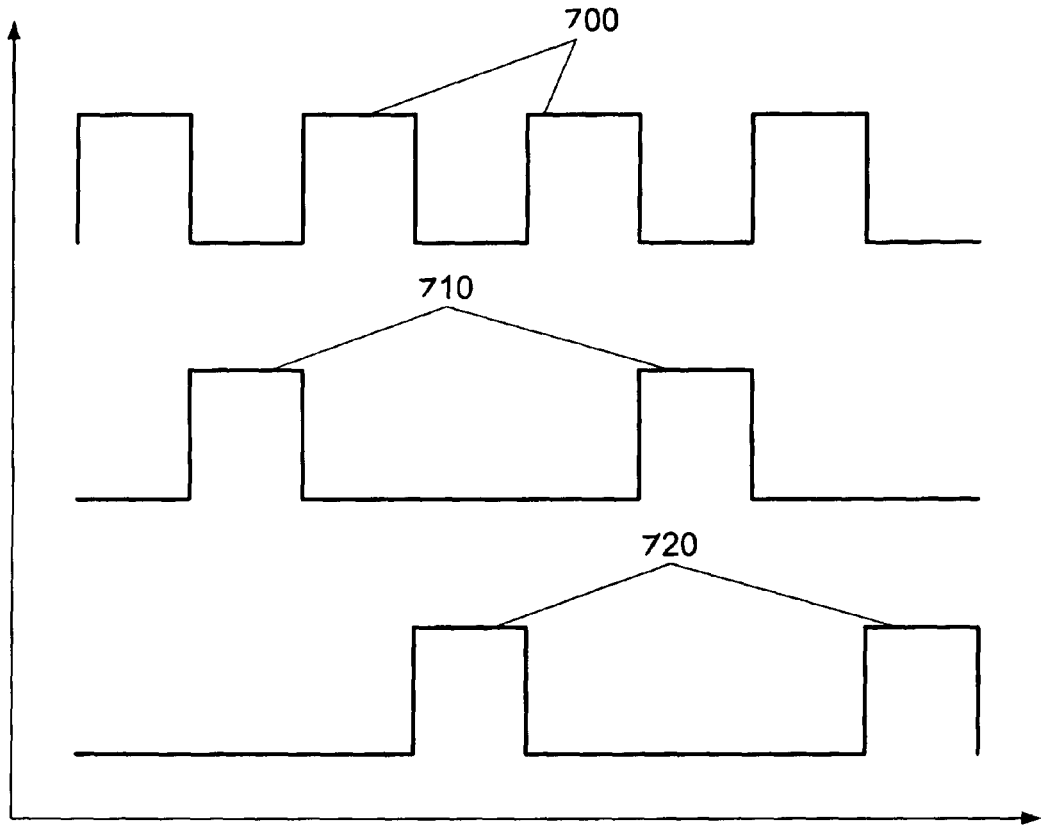
FIG. 7 is a graph showing time intervals during which the high pressure fluid and the first and second process compositions are deposited on the substrate

FIG. 7 is a graph showing time intervals during which the high pressure fluid and the first and second process compositions are deposited on the substrate. As discussed above, the high pressure processing systems 100, 200, 400, and 500 are configured to expose the substrate to sequential and intermittent pulses of the first process composition and the second process composition. In the preferred embodiment of the invention shown in the figure, during first time intervals 700 the substrate is exposed to only the high pressure fluid. The substrate is exposed to the high pressure fluid and the first process composition during time intervals 710, and is exposed to the high pressure fluid and the second process composition during time intervals 720. As discussed above, the substrate can be heated during process, such as to a temperature of at least 100° C. As also discussed above, the first processing composition can include a film precursor, and the second film composition can include a reducing agent.

Numerous modifications and variations of the present invention are possible in light of the above teachings. It is therefore understood that the invention may be practiced otherwise than as specifically described herein. In particular, it is understood that the present invention may be practiced by adoption of aspects of the present invention without adoption of the invention as a whole.

The invention claimed is:

1. A high pressure processing system, comprising:

a high pressure chamber which houses a substrate to be processed during a supercritical atomic layer deposition (ALD) procedure;

a fluid introduction system including a first composition supply system; a second composition supply system, at least one high pressure fluid supply system including a supercritical fluid source; and a controller operatively coupled to the high pressure processing system, wherein the controller is configured to:

direct the fluid introduction system to alternately and discontinuously introduce a first composition to the high pressure chamber from the first composition supply system during a first time interval and a third time interval, and introduce a second composition to the high pressure chamber from the second composition supply system during a second time interval and a fourth time interval during the supercritical ALD procedure, where the second time interval and the fourth time interval occur after the first time interval and the third time interval respectively, while processing the same substrate, direct the at least one high pressure fluid supply system to deliver a first supercritical fluid to the high pressure chamber during a plurality of purge cycles in the supercritical ALD procedure, effect a first purge cycle before the first time interval and a second purge cycle after the first time interval, and direct the high pressure fluid introduction system to include a second supercritical fluid and a film precursor in the first composition, and include a third supercritical fluid and a reducing agent in the second composition.

2. The high pressure processing system according to claim 1, wherein the first, second, and third supercritical fluids include supercritical carbon dioxide.

3. The high pressure processing system according to claim 1, wherein:

the high pressure chamber includes a platen which supports the substrate, and the platen is configured to heat the substrate to a temperature greater than 350 degrees Celsius but not more than 500 degrees Celsius.

4. The high pressure processing system according to claim 3, wherein the platen is configured to heat the substrate to a temperature greater than 500 degrees Celsius.

5. The high pressure processing system according to claim 1, wherein the controller is further configured to direct the fluid supply system to sequentially and intermittently introduce the first composition and the second composition to facilitate deposition of a film on the substrate, the first composition being deposited during the first time interval, and the second composition being deposited during the second time interval.

6. The high pressure processing system according to claim 1, wherein the controller is further configured to direct the fluid supply system to sequentially and intermittently introduce the first composition and the second composition during the supercritical deposition procedure to facilitate deposition of at least one of a metal film, a dielectric film, and a semiconductor film on the substrate.

7. The high pressure processing system according to claim 5, wherein the first composition includes a low-k dielectric film precursor, and the second composition includes a reducing agent.

8. The high pressure processing system of claim 1, wherein the first composition supply system comprises a high-speed valve capable of delivering at least one pulse of the first composition with a pulse duration less than 1 millisecond.

9. The high pressure processing system of claim 1, wherein the controller is configured to effect a circulation time of the high pressure fluid from the fluid introduction system through the high pressure chamber that is not less than about 1 second.

10. The high pressure processing system of claim 9, wherein the controller is configured to effect a ratio of the circulation time divided by a time duration of the first time interval that is not less than 1000.

11. The high pressure processing system of claim 9, wherein the controller is configured to effect a ratio of the circulation time divided by a time duration of the first time interval that is greater than 100 but not greater than 1000.

12. The high pressure processing system of claim 9, wherein the controller is configured to effect a ratio of the circulation time divided by a time duration of the first time interval that is greater than 10 but not greater than 100.

13. The high pressure processing system of claim 9, wherein the controller is configured to effect a ratio of the circulation time divided by a time duration of the first time interval that is not more than 10.

14. A high pressure processing system of claim 1, further comprising:

a first recirculation system including:

a first recirculation line extending from a first inlet of the chamber to a first outlet of the chamber;

a first recirculation pump disposed in the first recirculation line;

a first valve disposed in the first recirculation line downstream of the first recirculation pump;

a second valve disposed in the first recirculation line upstream of the first recirculation pump;

a first bypass line extending from the first valve to the second valve; and a first process chemistry supply system in fluid communication with the first recirculation line wherein the high pressure fluid supply system in fluid communication with a second inlet of the chamber; and the controller is further configured to:

deliver a first composition from the first process chemistry supply system into the first recirculation line, and recirculate the first composition through the first bypass line, thereby bypassing the first composition away from the chamber, while simultaneously delivering a high pressure fluid from the high pressure fluid supply system to the second inlet of the chamber.

15. The high pressure processing system according to claim 14, further comprising:

a second recirculation system including:

a second recirculation line extending from a third inlet of the chamber to a third outlet of the chamber;

a second recirculation pump disposed in the second recirculation line;

a third valve disposed in the second recirculation line downstream of the second recirculation pump;

a fourth valve disposed in the second recirculation line upstream of the second recirculation pump;

a second bypass line extending from the third valve to the fourth valve; and a second process chemistry supply system in fluid communication with the second recirculation line, wherein the controller is further configured to:

deliver a second composition from the second process chemistry supply system into the second recirculation line, and recirculate the second composition through the second bypass line, thereby bypassing the second composition away from the chamber, while simultaneously delivering a high pressure fluid from the high pressure fluid supply system to the second inlet of the chamber.

16. The high pressure processing system according to claim 15, wherein the controller is further configured to:

recirculate the second composition through the second bypass line, thereby bypassing the second composition away from the chamber, while simultaneously delivering the first composition to the first inlet of the chamber.

17. A supercritical processing system, comprising:

a supercritical chamber which houses a substrate during a supercritical atomic layer deposition (ALD) procedure;

means for introducing to the substrate a first composition and a second composition alternately and discontinuously disposed within a carrier fluid; and a controller operatively coupled to the means for introducing, wherein the controller is configured to direct the means for introducing to alternately and discontinuously introduce the first composition to the supercritical chamber during a first time interval and a third time interval, and introduce the second composition to the supercritical chamber during a second time interval and a fourth time interval, during the supercritical ALD procedure, where the second time interval and the fourth time interval occur after the first time interval and the third time interval respectively, while processing the same substrate.

18. The supercritical processing system according to claim 17, wherein the first and second compositions form an ALD film on the substrate.

19. The supercritical processing system according to claim 17, wherein the carrier fluid includes one of a high pressure and a supercritical fluid.

20. The supercritical processing system according to claim 19, wherein the first and second compositions include a film precursor and a reducing agent, respectively.

* * * * *